United States Patent [19]

Dekkers

[11] 4,347,648

[45] Sep. 7, 1982

[54] LADDER STRAP HARNESSING DEVICE WITH WEBBED TAIL

[75] Inventor: Leo P. Dekkers, Scituate Harbor, Mass.

[73] Assignee: Dennison Manufacturing Company, Framingham, Mass.

[21] Appl. No.: 149,210

[22] Filed: May 12, 1980

[51] Int. Cl.[3] ..... B65D 63/00; F16B 2/08

[52] U.S. Cl. ..... 24/16 PB; 24/17 AP; 24/297; 292/318; 292/322

[58] Field of Search ..... 24/16 PB, 16 R, 17 AB, 24/73 PB; 292/318, 321, 322

[56] References Cited

U.S. PATENT DOCUMENTS

| | | | |
|---|---|---|---|
| 2,183,799 | 12/1939 | Wenk, Jr. | 292/322 |
| 2,961,785 | 11/1960 | Toepfer | 24/16 PB |
| 3,197,164 | 7/1965 | Hansen | 24/16 PB |
| 3,339,247 | 9/1967 | Geisinger | 24/16 PB |
| 3,463,427 | 8/1969 | Fisher | 24/16 PB |
| 3,581,347 | 6/1971 | Verspieren | 24/16 PB |
| 3,837,047 | 9/1974 | Bunnell | 24/16 PB |
| 3,983,603 | 10/1976 | Joyce | 24/16 PB |
| 4,137,606 | 2/1979 | Wood | 24/16 PB |
| 4,183,119 | 1/1980 | Stewart et al. | 24/16 PB |

FOREIGN PATENT DOCUMENTS

| | | | |
|---|---|---|---|
| 1439156 | 6/1976 | United Kingdom | 24/16 PB |

*Primary Examiner*—Victor N. Sakran
*Attorney, Agent, or Firm*—George E. Kersey

[57] ABSTRACT

A harnessing device formed by a locking head and an attached ladder strap. The head contains a locking tang and a guide channel that receives the strap after encirclement of items to be harnessed. The tang engages the rungs of the ladder strap for the adjustable retention of the harnessed items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

8 Claims, 5 Drawing Figures

FIG. 3-A
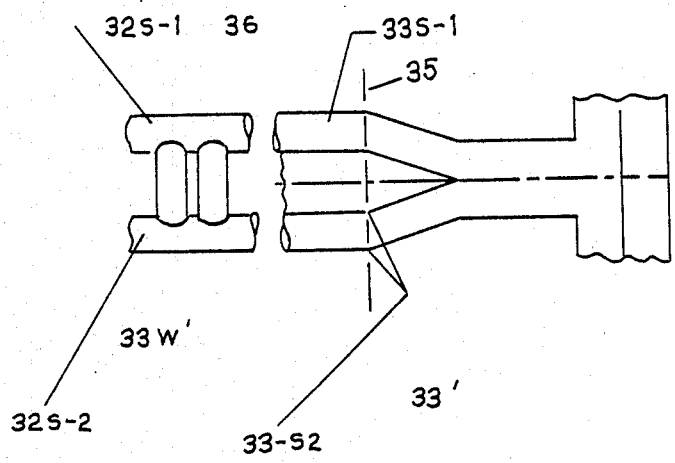
FIG. 3-B
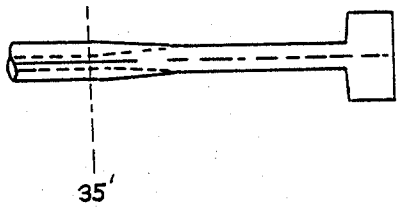

LADDER STRAP HARNESSING DEVICE WITH WEBBED TAIL

BACKGROUND OF THE INVENTION

This invention relates to the harnessing of the items and more particularly to the realization of efficient, low-cost, high strength harnessing devices which are easy to use.

Harnessing devices are widely used for the bundling of objects. Such devices are typically formed with a serrated strap that is fitted to an apertured head containing an internal pawl or locking tang that engages the serrations of the strap. Other harnessing devices are in the form of an apertured strap fitted to a buckle-like head, with a tongue that enters the apertures of the strap.

Harnessing devices with serrated straps have the disadvantage of being only as secure as their pawls. Where the items that are harnessed are heavy or are subjected to rough handling, the items often become accidentally released, for example, by failure of the pawls. Attempts have been made to strengthen serrated strap devices, but this has resulted in considerable complexity without achieving the desired end result of providing security against accidental release of the harnessed items. Similar objections apply to harnessing devices with buckle-like heads. In these devices, a tongue which enters the strap apertures rests against the head of the buckle near its opening and is deflected by the strap. The tongue is typically a cantilever attachment to the buckle-like head, which tends to be unduly stiff in the direction of forward thrust during harnessing, and insufficiently stiff in the direction of reverse thrust applied by the strap because of the harnessed items. In addition the tongue is exposed to external interferences that can cause an accidental release of the harnessed items.

In order to avoid and overcome many of the difficulties associated with the foregoing kinds of harnessing devices, ladder straps and associated locking tangs have been developed of the kind disclosed in U.S. Pat. No. 3,766,608, which issued Oct. 23, 1973. The ladder strap device represents a significant improvement over the serrated strap and other harnessing devices. It can accomplish substantially the same functions as a serrated strap device at a considerably lower cost. The ladder strap can be produced with a significant saving in material and can be stretched to reorient its molecular structure and strengthen its constituents without strap distortion, as would occur if an attempt were made to stretch a serrated strap.

Notwithstanding its advantages, however, the ladder strap typically includes a tail section that is inadequate in many situations to achieve desired speed and flexibility in use. For example, the commonly used tail can cause operator difficulty in insertion of the strap into the head. The tail also often provides an inadequate gripping surface for an automatic tool which is used to suitably tension the strap and then subsequently sever any excess length. The foregoing difficulties cannot be overcome by mere extension of the strap since that would result in a tail that contains too much bulk for efficient application. Such a tail would not only be difficult to handle, but it would be wasteful of material. Conversely, if the tail is made of reduced thickness as compared with the remainder of the strap, the resulting structure would have insufficient mass for efficient handling. It would also present difficulties in being grasped by tendency to move about uncontrollably because of its lack of bulk.

Accordingly, it is an object of the invention to provide for the secure harnessing of items. A related object is to achieve secure harnessing without the need for a complex harness configuration.

A further object of the invention is to provide a tail structure for a harnessing device which promotes the efficient, accurate and rapid use of the device. A related object is to provide a suitable tail structure for a harnessing device without an undue increase in bulk. Another related object is to overcome the difficulties associated with ordinary tail structures. Another object is to produce a suitable, economical tail structure. A related object is to produce a tail structure which has sufficient mass for suitable usage, while being sufficiently light in weight that it does not interfere with harnessing operations.

Another object of the invention is to reduce the material and molding requirements associated with the filling of molds and the production of harnessing devices with lengthened tail. A related object is to reduce molding and material requirements in the manufacture of ladder strap harnessing devices with elongated tails.

SUMMARY OF THE INVENTION

In accomplishing the foregoing and related objects the invention provides a harnessing device with a head, attached strap having an elongated tail portion. The head contains a guide channel and a locking tang. The strap is advantageously in the form of a ladder structure and is used to encircle the items to be harnessed. The strap desirably extends at an angle from the locking head with respect to the longitudinal direction of the guide channel. The elongated tail includes intersecting side rails bounding a central web portion. The webbing reduces the force required for insertion of the strap into the head and limits the tendency of thrust applied to the strap from fracturing the pawl or producing counter rotation.

The inclusion of webbing further permits the strap to be molded with an improved filling characteristic. The webbing region of the mold serves as a channel for the flow of the molding material to the rungs thus assuring complete filling of each rung cavity. The webbing also limits the occurrence of such imperfections as voids, "nits" and "cold shuts". Voids are produced by gaseous bubbles during turbulent flow of the mold mixture. A "nit" is an imperfection in the surface of the molded part, particularly a surface discontnuity in the nature of a stress crack. The webbing produces strengthening of the overall structure and is stretchable in the case of molecular reorientable materials to provide increased strength per unit area. A "cold shut" is a molding discontinuity that occurs because of premature chilling which forms a skin-like layer of material that is not integrally tied to the remainder of the structure. The additional flow of material because of the webbing channel permits the completion of filling before chilling takes place.

The intersecting side rails provide reinforcement for the elongation of the tail without adding undesirably to the bulk of the tail, and the intersection defines the tip of the tail with respect to which stretching can take place. In many situations with stretchable straps a difficulty is presented by the need to include in the tail an auxiliary member with respect to which stretching can take place. The provision of a web at the tip intersection of rails defining the end of the tail provides a stretching point without requiring any auxiliary structure on the strap.

DESCRIPTION OF THE DRAWINGS

Other aspects of the invention will become apparent after considering several illustrative embodiments taken in conjunction with the drawings in which:

FIG. 3A is a plan view of an unstretched version of the tail portion of FIG. 2A; and FIG. 3B is a side view of FIG. 3A.

DETAILED DESCRIPTION

Figure 1:
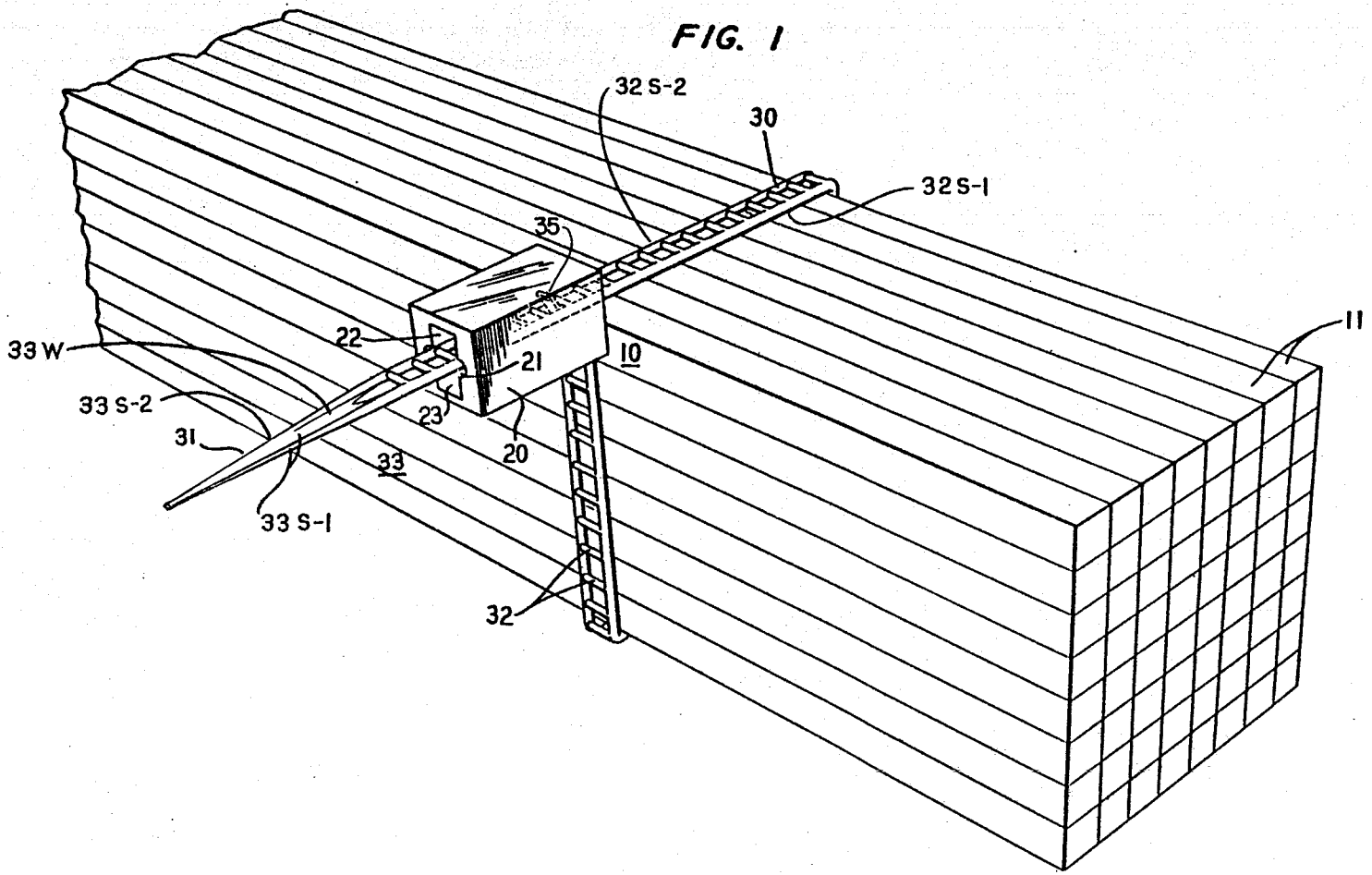
FIG. 1 is a perspective view of a harnessing device with an elongated tail in accordance with the invention.

As shown in FIG. 1, a harnessing device 10 in accordance with the invention includes a head 20 and an attached strap 30. The strap 30 is in the form of a ladder structure with side rails 32*s*-1 and 32*s*-2 and rungs 32*r*. The free end 31 of the strap 32 includes an elongated webbed tail 33 which is insertable into a channel 21 of the head 20 to bring the strap into engagement with an internal locking tang or pawl (not visible in FIG. 1) which may be stationary or deflectable.

The tail 31 of the strap 30 is formed by extensions 33*s*-1 and 33*s*-2 of the side rails 32*s*-1 and 32*s*-2. Webbing 33*w* occupies the interval between the extension side rails 33*s*-1 and 33*s*-2. Because of the webbing 33*w* the extended tail 33 is of relatively light weight; because of the rail extensions 33*s*-1 and 33*s*-2 the tail has sufficient rigidity for customary use. A suitable thickness for the web has been found to be in the range from about 2 to about 7 mils with a range of from about 3 to about 5 mils being preferred.

The provision of the webbing 33*w* facilitates production of the device 10 with improved operating, molding and stretching characteristics. Because of the web 33*w* the material inserted into the mold, which is advantageously accomplished by injection molding, has an enlarged channel for the flow of material, as compared with the standard ladder structure. The result is that imperfections that often attend molding, such as cold shuts, voids and nit marks are either eliminated or significantly reduced in extent.

Figure 2A:
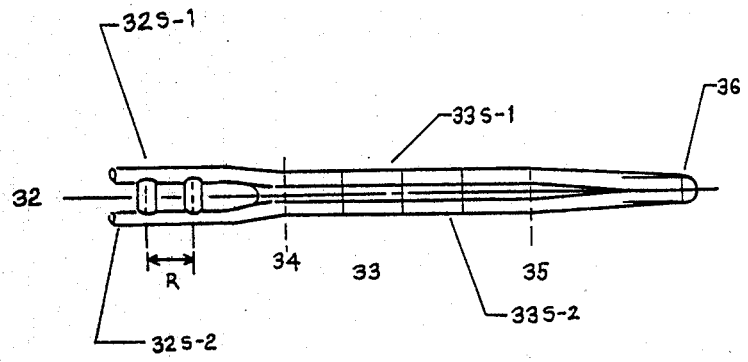
FIG. 2A is a plan view of the tail portion of the device of FIG. 1.
Figure 2B:
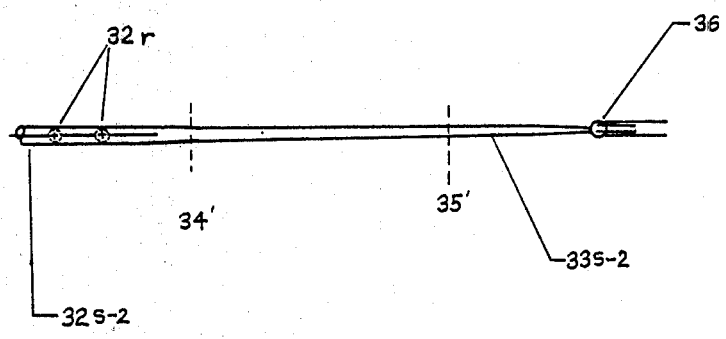
FIG. 2B is a side view of FIG. 2A.

In those cases where the strap 30 is to be stretched it is desirable for the material to be of molecular reorientable type, such as nylon, polypropylene, polyester, urethane, or the like. This material, upon stretching, not only reduces the volume per unit length of the strap, as indicated in FIGS. 2A and 2B but also provides enhanced physical properties. For example there is increased strength in tensile and shear strength.

The configuration of the tail portion 33 of a stretched strap 30 in accordance with the invention is shown in plan view in FIG. 2A and in side view in FIG. 2B. The main portion of the strap 30 includes side rails 32*s*-1 and 32*s*-2 and rungs 32*r*. The inter-rung interval R is advantageously greater than the thickness on any individual rung. The tail 33 includes a web 33*w* which extends between each pair of adjoining rails 33*s*-1 and 33*s*-2. In the particular embodiment of FIGS. 2A and 2B the tail side rails 33*s*-1 and 33*s*-2 join the main side rails 32*s*-1 and 32*s*-2 at an angled junction 34 and extend continuously all the way around the webbed portion 33*w*. This facilitates the stretching of the tail portion 33 which includes a further angled junction 35 near the tip 36. The portion of the tail extending between the junctions 34 and 35 desirably extends over about five inter-rung intervals. The actual length between the junctions 34 and 35 may be as little as one inter-rung interval and may be more than five inter-rung intervals. The portion of the tail beyond the second junction has a webbed region on the order of one inter-rung interval and a convergence of the rail extensions also on the order of one inter-rung interval. The webbed and convergence regions may each be as little as a half inter-rung interval and may be more than two inter-rung intervals.

The device 10 may also be used with an unstretched strap, in the form removed from the mold. The spacing between adjoining rails 33*s*-1′ and and 33*s*-2′ can be controlled by controlling the extent of strap stretching.

As can be seen from the side view of FIG. 2B the tail 33 shows as angled junctions 34′ and 35′ with respect to the thickness of the strap, with the side rails 32*s*-1 and 32*s*-2 being tapered to the junction 34′ and the extension rails 33*s*-1 and 33*s*-2 being tapered beyond the second junction 35′. The extension rails 33*s*-1′ and 33*s*-2′ are substantially uniform in the interval between the junctions 34′ and 35′.

It will be understood that the webbed tail may be formed without the angled junction 34 or the angled junction 34′. An unstretched webbed tail 36 with a single angled junction 35 is shown in FIG. 3A. The extension side rails 33*s*-1 and 33*s*-2 are direct extensions of the strap side rails 32*s*-1 and 32*s*-2. When the webbed tail of FIG. 3A which is shown in side view in FIG. 3B is stretched the result is similar to that depicted in FIGS. 2A and 2B except that there is no angled junction corresponding to the junction 34 and the extension side rails 33*s*-1 and 33*s*-2 tend to become tapered with respect to the main rails 32*s*-1 and 32*s*-2 instead of being parallel as shown in FIG. 2A. In any case the separation of the extension side rails 33*s*-1 and 33*s*-2 is no greater than that of the main rails 32*s*-1 and 32*s*-2, and is generally less as shown in FIG. 2A. Similarly the thickness of the Webbed tail at the extension rails is no greater than the thicknesses of the main rails 32*s*-1 and 32*s*-2 and is typically slightly less as indicated in FIG. 2B, and generally exhibits a taper from at least the second junction 35 to the tip 36, also as shown in FIG. 2B.

The webbing 33*w*′ is shown as filling the entire interval between each pair of adjoining rungs but it will be understood that the web may extend only a portion of the interrung distance and may be detached from the side rails.

While various aspects of the invention have been set forth by the drawings and the specifications, it is to be understood that the foregoing detailed description is for illustration only and that various changes in parts as well as the substitution of equivalent constituents for those shown and described, may be made without departing from the spirit and scope of the invention as set forth in the appended claims.

What is claimed is:

1. A harnessing device comprising a head having an elongated guide channel extending therethrough, a locking tang within said head, and a strap formed by a structure with members which are sequentially engaged by the locking tang when the strap is inserted into the channel, said strap having a webbed tail portion flanked by side rails which extend from said members continuously surrounding said webbed portion and forming an angle with said strap.

2. A harnessing device as defined in claim 1 wherein said members which are sequentially engaged by said locking tang comprise rungs.

3. A harnessing device as defined in claim 1 or claim 2 wherein said side rails extend along said strap adjoining said members which are sequentially engaged by said locking tang.

4. A harnessing device as defined in claim 1 or 2 wherein said device is molded from a stretch-reorientable material and the webbed portion of said strap is characterized by having permanent molecular reorientation caused by stretching, thereby to realize a relatively thin and strengthened member extending between the edges of said strap at the tail portion thereof.

5. A harnessing device as defined in claim 1 wherein said strap includes rungs which are engageable with said locking tang and the length of said tail portion is at least equal to the interval between two successive rungs of said strap.

6. A harnessing device as defined in claim 1 wherein said side rails extend substantially parallel over a region of said tail portion.

7. A harnessing device as defined in claim 1 or 2 wherein one end of said strap is attached to said head at an angle with respect to the axis of insertion of the other end of said strap to said channel.

8. A harnessing device as defined in claim 1 or 2 wherein said locking tang is deflectable.

* * * * *